United States Patent [19]

Deinert et al.

[11] 4,103,844

[45] Aug. 1, 1978

[54] REEL

[75] Inventors: J. Clifford Deinert, Waverly; Charles E. Taylor, Summit; Harry W. Mumford, Waverly, all of Pa.

[73] Assignee: Sandvik, Inc., Scranton, Pa.

[21] Appl. No.: 787,371

[22] Filed: Apr. 14, 1977

[51] Int. Cl.[2] ..... B65H 75/48

[52] U.S. Cl. ..... 242/107

[58] Field of Search ..... 242/107–107.7

[56] References Cited

U.S. PATENT DOCUMENTS

| | | | |
|---|---|---|---|
| 681,864 | 9/1901 | Wallace et al. | 242/107.5 |
| 2,505,920 | 5/1950 | Sporket | 242/107 X |
| 3,007,653 | 11/1961 | Becker | 242/107.5 |
| 3,352,508 | 11/1967 | Hadley | 242/107 |
| 3,744,759 | 7/1973 | Jennings | 242/107 |

*Primary Examiner*—Harvey C. Hornsby
*Assistant Examiner*—John M. Jillions
*Attorney, Agent, or Firm*—Harold L. Stults

[57] ABSTRACT

A reel for an anchor rope or line on a boat having springs to rewind the rope or the like. One or more springs may be used, although several small springs are preferred. Any particular size of reel may require a different number of springs for various sizes and weights of ropes which may be wound. When less than the maximum number of springs is required, a spacer is used to replace the unnecessary spring or springs without any other change in the reel construction.

9 Claims, 5 Drawing Figures

Fig. 1
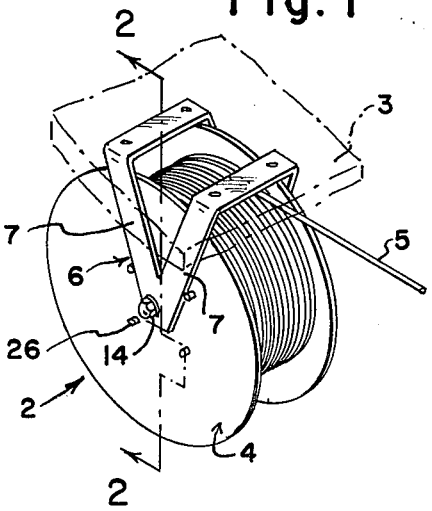
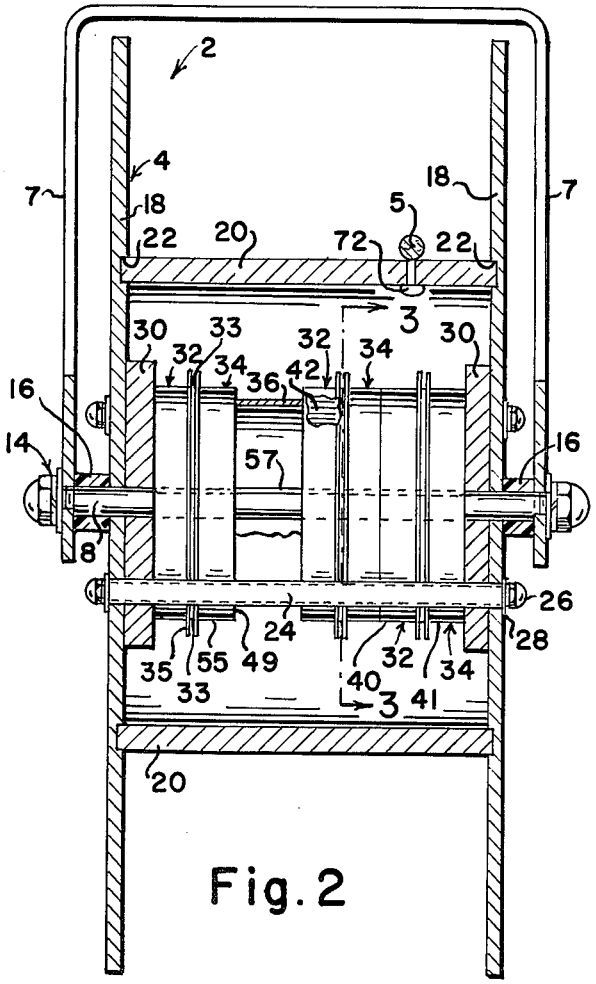
Fig. 2
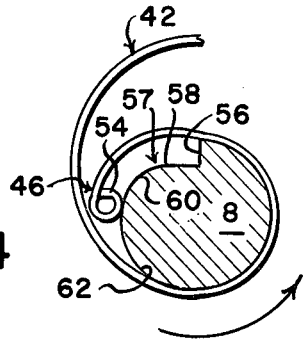
Fig. 4
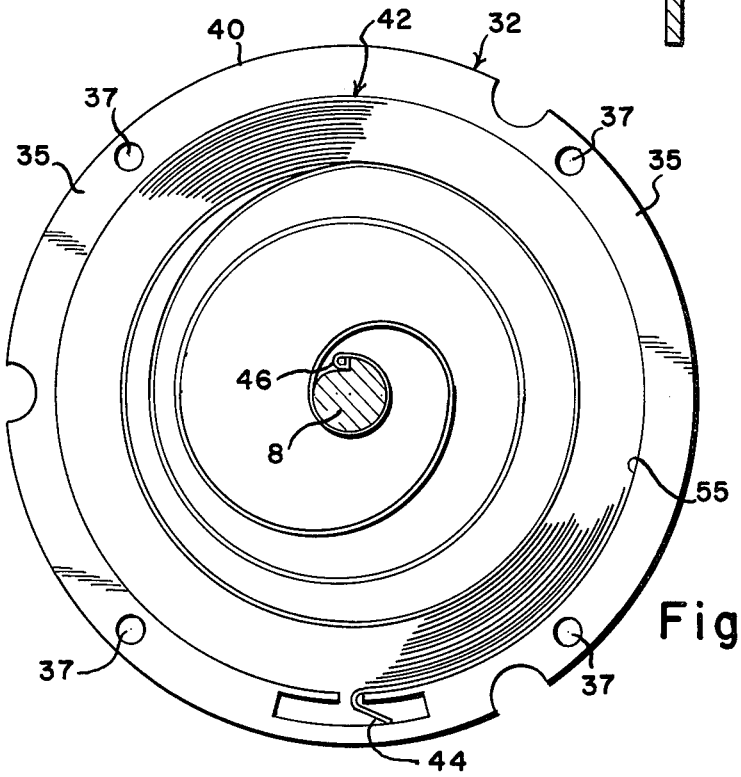
Fig. 3
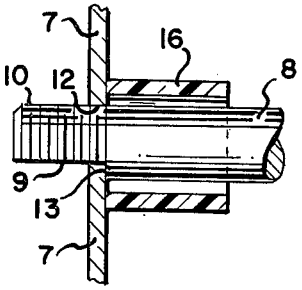
Fig. 5

REEL

This invention relates to reels upon which ropes and the like are wound by spring action. Such reels are used in various fields where the rope or other item is unwound by pulling it, and it is then rewound onto the reel by the spring action when it is released. The present invention relates particularly to reels for anchor ropes or lines on small boats.

An object of this invention is to provide an improved reel of the above type. A further object is to provide for the above with a construction which is sturdy, simple and compact, and which is dependable in operation. A further object is to provide reels of the above character which are adaptable to various conditions of operation and use. These and other objects will be in part obvious and in part pointed out below.

Referring to the drawings showing one embodiment of the invention:

FIG. 1 is a perspective view of the reel assembly mounted on the underside of the deck of a boat;

FIG. 2 is a vertical section on the line 2—2 of FIG. 1 with certain of the spring assemblies shown in full elevation;

FIG. 3 is a vertical section on the line 3—3 of FIG. 2;

FIG. 4 is a detailed view of the center portion of FIG. 3; and,

FIG. 5 is an enlarged detailed view of the left-hand central portion of FIG. 2.

Referring to FIG. 1 of the drawings, a reel assembly 2 is mounted upon the underside of a boat deck (not shown) and operatively positioned to wind up an anchor rope 5. Rope 5 extends through a port (not shown) and its end is attached to the anchor. When the anchor is dropped into the water, the weight of the anchor pulls the rope and unwinds it from the reel assembly. When the anchor is in place to anchor the boat, the rope is attached at the bow or deck of the boat. Later, when the anchor is pulled up the rope is automatically rewound onto the reel assembly by a spring action to be described below. The reel assembly 2 has a reel 4 mounted upon two parallel pairs of arms 7 of a sheet metal base stand 6 by a shaft 8 (See also FIGS. 2 and 5). Each end of shaft 8 is cut away to provide a flat bottom surface 9 on a portion 10 which extends through a hole 12 of the same shape in the respective arm 7. The shaft end is threaded and is clamped to the stand by a nut and washer 14, with the stand portion resting against the shoulder 13 at the end of the flat portion 10. Hence, the shaft is clamped in place and held from turning in the stand.

Reel 4 is of lesser width than the spacing between arms 7, and a spacer sleeve 16 is positioned between each arm and the reel. Reel 4 has two side plates 18 and a cylindrical drum 20 positioned therebetween and supported thereby. Each of the side plates has an annular recess 22 of the radius and radial dimension of drum 20, and each end of the drum extends into its recess to provide a mating relationship, whereby the side plates and the drum form a rigid reel unit when the side plates are held in place. Four metal rods 24 extend through the reel parallel to the reel axis and are threaded at their ends beyond the respective side plates. A nut 26 is threaded onto each rod end with a flat washer and a lock washer (shown at 28). Positioned at the side of each of the side plates toward the center of the reel is a square bearing plate 30 which has a center bore through which shaft 8 extends. Each plate 30 is held in place by rods 24 extending through holes in the plate. Positioned between and clamped by plates 30 are six spring assemblies identified alternately as 32 and 34, and a spacer sleeve 36. The spring assemblies and the spacer sleeve are cylindrical with their axes concentric with the axis of reel 4 and shaft 8. The total axial dimension of bearing plates 30, spring assemblies 32 and 34 and spacer sleeve 36 is precisely the axial dimension between the opposing surfaces of side plates 18 provided by the drum 20. Hence, the reel is a rigid, sturdy construction which rotates upon shaft 8 supported at bearing plates 30. As shown in FIG. 3, each of the spring assemblies has a flange 35 with an annular wafer disc 33 therebetween, and with holes 37 therein through which rods 24 extend, thus accurately positioning the spring assemblies and preventing rotation thereof.

The reel may be assembled with its axis positioned vertically by first placing shaft 8 and rods 24 in one of the side plates with the washers 28 and nuts 26 on the lower ends of the rods, and positioning that side plate with the rods and shaft extending upwardly. One bearing plate 30 is then put in position on the rods and shaft, followed by the spring assemblies 32 and 34, spacer sleeve 36, and the other bearing plate 30. During installation of the spring assemblies, each of the springs is operatively engaged with shaft 8 in the manner described below. Drum 20 is then put in position and the assembly is completed by adding the other side plate 18 and putting the washers and nuts onto the ends of the rods 24.

Each of the spring assemblies 32 and 34 is formed by a cup 40 or 41, respectively, with a coil spring 42 nested in each cup. Each spring is formed of a wound flat strip of steel and has an outer end anchor 44 and an inner end anchor loop 46. Cups 40 and 41 are identical in structure in that each has a cylindrical outer wall 55, a disc-shaped side or bottom wall 49 attached to one edge of wall 55, and a flange 35 extending from the other edge of wall 55. As shown in FIG. 2, there are three mating pairs of the cups, each pair being one cup 40 and one cup 41 with the flanges of the two cups pressed together and thereby providing a closed cylindrical chamber around the two coil springs.

Each of the inner end anchor loops 46 is formed by a semi-cylindrical portion of the spring and a flat end portion 54. Each of the outer end anchors 44 is a reverse V-bend end portion of the spring which extends through a slot in the outer wall 55 of its cup. Shaft 8 has a longitudinal groove 54 throughout its length (See FIGS. 2, 3 and 4) which is defined by a surface 56 (FIG. 4) which extends radially with respect to the shaft axis. A flat surface 58 extends at right angles to surface 56 and an arcuate surface 60 is co-extensive with surface 56 at its near edge and at its outer edge with the full-radius outer surface of the shaft.

When each of the springs is in its normal operating position (FIG. 3), the inner end of the spring is anchored to the shaft with the loop 46 positioned against surfaces 56 and 58. However, as will be discussed more fully below, when the spring is fully unwound and is then rotated counterclockwise from the position shown in FIG. 3, loop 46 slides freely from surfaces 56 and 58 around surface 60 and thence (See FIG. 4) around surface 62, and the rotation can continue without damage to the spring or other reel components. Hence, the spring is anchored firmly on the shaft when the outer end of the spring is turned clockwise from the position of FIG. 4, but the spring is free to rotate around the shaft in the counterclockwise direction of FIG. 4.

Referring now to FIG. 1, assume that the reel is rigidly mounted on the bottom surface of a deck of a boat and that an anchor line or rope 5 is coiled onto the reel and is attached to drum 20 (See FIG. 2) by a clip 72. When the anchor is placed into use, rope 5 is drawn from the reel and the reel is rotated (clockwise in FIG. 1). That rotates each of the spring assemblies around the stationary shaft 8, and each of the springs 42 is rotated clockwise (FIG. 3) with its inner anchor loop 46 being held against surface 56 on shaft 8. The turning of each spring winds its inner end around shaft 8 until the rope is unwound the desired amount. In practice, a knot or other stop means is provided on the rope to limit the extent of unwinding. The rope is then made fast on the deck. When the anchor is lifted, the rope is released and the constant pull by the springs turns the reel counterclockwise and rewinds the rope onto the drum 20. During the rewinding operation, the reel rotates rapidly enough to keep the rope somewhat taut. However, if the rope should break or be disconnected from the drum or the anchor, the drum would be completely free to turn and the springs would tend to rotate the drum at a very rapid rate. The reel would then have considerable momentum, and would continue its counterclockwise rotation after the complete unwinding of the springs. Each of the springs would then rotate with the drum (FIG. 3) with its inner end moving around the shaft, moving past its anchoring position as illustrated in FIG. 4. That provides a "ratchet-effect" so that the spring is not broken or damaged by the counterclockwise rotation, as would occur if the springs were firmly anchored to the shaft. Also, when the reel is again turned in a clockwise direction, the end anchor loops on all of the springs are moved simultaneously to the position shown in FIG. 3, and the springs are then wound by the continued rotation of the reel.

While the illustrative embodiment is a reel for the anchor line or rope on a boat, it is understood that the reel can be used in many different applications. The size of the reel is such as to provide the desired capacity and the operating relationship for a rope or other item of a particulwar diameter and length. The springs are of the proper number and have the desired characteristics to wind the rope or other item onto the reel at an acceptable rate. In the illustrative embodiment, the side plates and bearing plates are all rigid plastic, but it is understood that metal may be used where that is desirable. It is also understood that other modifications can be made in the construction without departing from the scope of the invention as defined in the claims.

What is claimed is:

1. A reel construction comprising, the combination of, mounting means comprising a pair of fixed side members which are spaced from each other, fixed axis means mounted respectively in said side members, a reel spool rotatably mounted on said axis means and having side discs adjacent said side members and a cylinder positioned between said side discs and presenting a surface having the same axis as said axis means and forming with said discs a space within which a rope or the like can be wound, a pair of bearing plates positioned respectively adjacent said discs within said cylinder, a plurality of bolts extending through said reel parallel to said axis and positioned less than the radius of said cylinder therefrom, whereby said discs are clamped against said cylinder by said bolts, and a plurality of coil spring assemblies having axes concentric with said axis, each of said spring assemblies comprising a coil spring and a cylindrical casing surrounding the spring, each of said springs having an inner anchor adjacent said axis means and forming a releasable operating connection therewith and having its outer end fixed to its casing, said operating relationship being formed by a notch in said axis means providing a surface which extends radially from said axis and said inner anchor of said surface having an end anchor portion engaging said surface.

2. The reel construction as described in claim 1 wherein said spring assemblies are positioned between said bearing plates, and which includes cylindrical spacing means of lesser diameter than said spring assemblies, and wherein the total of the axial dimensions of said spring assemblies and said plates and said spacing means equals the dimension between said discs when said discs are clamped by said bolts against the ends of said cylinder.

3. A reel construction as described in claim 2 wherein each of said discs has an annular recess co-extensive with the adjacent end face of said cylinder, and wherein said cylinder has its ends nested respectively in said annular recesses.

4. A reel construction as described in claim 3 wherein each of said side members has a hole therein through which the adjacent end of said axis means extends to provide the mounting therefor, and wherein the periphery of each of said holes and the adjacent end of said axis means are shaped to provide a mating relationship which is not round, and wherein said axis means has a shoulder at each of said side members against which that side member rests, and means threaded onto the end of the said axis means to clamp said side member thereto.

5. A reel construction as described in claim 1 wherein said axis means comprises a unitary axle having a surface of maximum radius which is a portion of a cylinder and having its ends extending through and fixed in said side members, respectively, said axle having a longitudinal groove extending throughout the axial extent of said springs and defined by said first-named surface from the periphery of the axle toward said axis and thence by a surface which extends at right angles to the first-named surface and has a curved portion which extends into alignment with said maximum radius surface of said axle.

6. A reel construction as described in claim 1 wherein said side plates and bearing plates are of rigid plastic.

7. A reel construction as described in claim 1 wherein each of said spring assemblies has a flange at its periphery with openings therein through which said bolts extend.

8. A reel construction as described in claim 1, wherein each of said fixed side members comprises radial metal strips and said side members are interconnected to form a pair of U-shaped members.

9. A reel construction comprising, the combination of, mounting means comprising a pair of fixed side members which are spaced from each other, a fixed axle having ends mounted respectively in said side members, a reel spool rotatably mounted on said axle and having side disc structures adjacent said side members and a cylinder positioned between said disc structures and presenting a surface having the same axis as said axle, said cylinder forming with said disc structures a space within which a rope or the like can be wound, each of said disc structures being rotatably mounted upon said shaft so as to provide for the rotation of said reel spool, a plurality of bolts extending through said reel spool parallel to said axis and positioned less than the radius of said cylinder therefrom, whereby said disc structures are clamped against said cylinder by said bolts, and a pair of coil spring assemblies mounted upon said axle and having axes concentric with said axis, each of said spring assemblies comprising a coil spring and a cup forming a cylindrical casing surrounding the spring, each of said cups having an open top which is closed by the cup of the other spring assembly of said pair, each of said springs having an inner anchor adjacent said axle and forming a releasable operating connection therewith and having its outer end fixed to its casing, said operating relationship being formed by a notch in said axle providing a surface which extends radially from said axis and said inner anchor of said spring having an end anchor portion engaging said surface.

* * * * *